US006676773B2

(12) United States Patent
Kaneko et al.

(10) Patent No.: US 6,676,773 B2
(45) Date of Patent: Jan. 13, 2004

(54) RARE EARTH MAGNET AND METHOD FOR PRODUCING THE MAGNET

(75) Inventors: Yuji Kaneko, Uji (JP); Junichiro Baba, Osaka (JP); Katsuya Taniguchi, Sanda (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 122 days.

(21) Appl. No.: 09/985,671

(22) Filed: Nov. 5, 2001

(65) Prior Publication Data

US 2002/0129874 A1 Sep. 19, 2002

(30) Foreign Application Priority Data

Nov. 8, 2000 (JP) ..... 2000-340763

(51) Int. Cl.[7] ..... H01F 1/057
(52) U.S. Cl. ..... 148/302; 420/83; 420/121
(58) Field of Search ..... 148/302; 420/83, 420/121

(56) References Cited

U.S. PATENT DOCUMENTS

| | | | | | |
|---|---|---|---|---|---|
| 5,716,462 | A | * | 2/1998 | Sakurada et al. | 148/302 |
| 5,788,782 | A | | 8/1998 | Kaneko et al. | |
| 6,159,308 | A | | 12/2000 | Uchida et al. | |
| 6,322,637 | B1 | * | 11/2001 | Hirota et al. | 148/302 |
| 2002/0003007 | A1 | * | 1/2002 | Hirota et al. | 148/302 |
| 2002/0117237 | A1 | * | 8/2002 | Takaki et al. | 148/302 |
| 2003/0084964 | A1 | * | 5/2003 | Okayama et al. | 148/302 |

FOREIGN PATENT DOCUMENTS

| | | | | |
|---|---|---|---|---|
| EP | 0 295 779 A3 | | 12/1988 | |
| EP | 0 651 401 A1 | | 5/1995 | |
| JP | 62-229803 | * | 10/1987 | 420/83 |
| JP | 63-033505 | | 2/1988 | |
| JP | 3-167803 | | 7/1991 | |
| JP | 04-114409 | | 4/1992 | |
| JP | 8-088112 | | 4/1996 | |
| JP | 63-116404 | | 5/1998 | |
| JP | 10-317110 | | 12/1998 | |
| JP | 11-054351 | | 2/1999 | |
| JP | 2000-219942 | | 8/2000 | |
| JP | 2000-219943 | | 8/2000 | |

OTHER PUBLICATIONS

J. Bernardi, et al., "Microstructural analysis of strip cast Nd–Fe–B alloys for high (BH) $_{max}$ magnets", Journal of Applied Physics, vol. 83 No. 11, Jun. 1998, pp. 6396–6398.
Y. Kaneko et al., "Recent Developments of High–Performance NEOMAX Magnet", Journal of Materials Engineering and Performance, vol. 3(2), Apr. 1994, pp 228–233.
U.S. patent application Ser. No. 09/851,423, Hkatsumi Okayama et al., "Rare Earth Magnet and Method for Manufacturing the Same", filing Date May 9, 2001.

* cited by examiner

*Primary Examiner*—John Sheehan
(74) *Attorney, Agent, or Firm*—Keating & Bennett, LLP

(57) ABSTRACT

A method of making an alloy powder for an R—Fe—B-type rare earth magnet includes the steps of preparing a material alloy that is to be used for forming the R—Fe—B-type rare earth magnet and that has a chilled structure that constitutes about 2 volume percent to about 20 volume percent of the material alloy, coarsely pulverizing the material alloy for the R—Fe—B-type rare earth magnet by utilizing a hydrogen occlusion phenomenon to obtain a coarsely pulverized powder, finely pulverizing the coarsely pulverized powder and removing at least some of fine powder particles having particle sizes of about 1.0 μm or less from the finely pulverized powder, thereby reducing the volume fraction of the fine powder particles with the particle sizes of about 1.0 μm or less, and covering the surface of remaining ones of the powder particles with a lubricant after the step of removing has been performed.

2 Claims, 7 Drawing Sheets

RARE EARTH MAGNET AND METHOD FOR PRODUCING THE MAGNET

BACKGROUND OF THE INVENTION

1. Field of the Invention

The present invention relates to an R—Fe—B-type rare earth magnet, an alloy powder for such a rare earth magnet, a method of making the powder, and a method for producing the magnet.

2. Description of the Related Art

A rare earth sintered magnet is produced by pulverizing a material alloy for the rare earth magnet to obtain an alloy powder, compacting the alloy powder, sintering the compact and then subjecting the sinter to an aging treatment. The rare earth sintered magnets extensively used today for various applications are roughly classifiable into the two types, namely, samarium-cobalt-type magnets and rare earth-iron-boron-type magnets. Among other things, the rare earth-iron-boron-type magnets (which will be referred to herein as "R—Fe—B-type magnets", where R is one of the rare earth elements including Y, Fe is iron and B is boron) recently have been extensively applied to various types of electronic apparatuses. This is because an R—Fe—B-type magnet can exhibit a higher magnetic energy product than any other type of permanent magnet and yet is relatively inexpensive. It should be noted that a transition metal element such as Co may be substituted for a portion of Fe in the R—Fe—B-type magnet, and carbon may be substituted for a portion of boron.

A powder of a material alloy for an R—Fe—B-type rare earth magnet is sometimes prepared by a method including first and second pulverization processes. That is to say, the material alloy is coarsely pulverized in the first pulverization process and then the coarsely pulverized alloy is finely pulverized in the second pulverization process. More specifically, the material alloy is embrittled in the first pulverization process by utilizing a hydrogen occlusion phenomenon so as to be coarsely pulverized to sizes of several hundreds of micrometers or less. Thereafter, in the second pulverization process, the coarsely pulverized alloy (or coarsely pulverized powder) is finely pulverized to a mean particle size that is several micrometers using a jet mill machine or other suitable apparatus.

Methods for preparing the material alloy itself may also be generally classifiable into the two types: ingot casting and rapid cooling processes. Specifically, in an ingot casting process, a melt of the material alloy is poured into a casting mold and cooled in the casting mold relatively slowly. Typical examples of the rapid cooling processes include a strip casting process and a centrifugal casting process. In the rapid cooling process, a melt of the material alloy is brought into contact with, and rapidly cooled by, a single roller, twin rollers, a rotating chill disk, a rotating cylindrical chill mold or other similar device, thereby making a solidified alloy that is thinner than an ingot cast alloy.

In a rapid cooling process as described above, a melt of a material alloy is normally cooled at a rate of $10^{2\circ}$ C./sec to $2\times10^{4\circ}$ C./sec. A rapidly solidified alloy prepared by the rapid cooling process usually has a thickness of 0.03 mm to 10 mm. The melt starts to solidify upward at the lower surface thereof that is in contact with a chill roller (which surface will be referred to herein as a "roller contact surface"). From the roller contact surface, crystals in the shape of pillars (columns) or needles grow upward in the thickness direction. As a result, the rapidly solidified alloy has a microcrystalline structure including an $R_2T_{14}B$ crystalline phase and an R-rich phase. Fine crystal grains of the $R_2T_{14}B$ phase have a minor-axis size of 0.1 $\mu$m to 100 $\mu$m and a major-axis size of 5 $\mu$m to 500 $\mu$m. The "R-rich phase" as used herein means a non-magnetic phase in which a rare earth element R is present at a relatively high percentage. The R-rich phase is dispersed around the grain boundaries of the $R_2T_{14}B$ phase. The thickness of the R-rich phase (corresponding to the width of the grain boundaries) is 10 $\mu$m or less.

Compared to an ingot cast alloy, i.e., an alloy prepared by the known ingot casting (or mold casting) process, the rapidly solidified alloy has been cooled in a relatively short time. Thus, the rapidly solidified alloy has a finer structure with smaller crystal grain sizes. Also, in the rapidly solidified alloy, crystal grains are finely dispersed, the grain boundaries thereof have a wider area and the R-rich phase is distributed thinly over the grain boundaries. Accordingly, the rapidly solidified alloy is also advantageous in the dispersion of the R-rich phase.

After a rapidly solidified alloy such as that described above has been pulverized by the above-described techniques, the resultant powder is compacted using presses, thereby obtaining a powder compact. Also, by sintering this powder compact, an R—Fe—B-type rare earth magnet can be obtained.

In the prior art, a block-shaped sintered magnet, which is greater in size than a size of the final magnet product, is formed and then cut and/or processed to obtain a magnet having a desired shape and size.

Recently, however, a sintered magnet having a non-ordinary complex shape (e.g., arced shape) is in high demand. In response to this demand, even an as-pressed powder compact should sometimes have a shape that is close to that of a final magnet product. To make a compact having such a complex shape, a pressure to be applied to the powder being pressed and compacted (which pressure will be herein referred to as a "compaction pressure") should be reduced compared to the known process. In producing an anisotropic magnet, the compaction pressure is low to increase the degree of magnetic alignment of the powder particles.

If the compaction pressure is reduced, however, the resultant compact density is reduced, and eventually its strength is decreased. As a result, the compact easily cracks or chips when the as-pressed compact is unloaded from the die cavity of the press or in any of the various succeeding process steps. In particular, an alloy powder for an R—Fe—B-type rare earth magnet often has an angular shape and has a compactibility that is inferior to those of other magnet material powders. Also, if the material alloy has a fine structure as in a strip cast alloy, then the powder obtained by pulverizing such an alloy should have a sharp particle size distribution. Accordingly, the springback (i.e., the elastic recovery of a compact that is observed when the compaction pressure applied to the powder is released) is remarkably observed in such a compact. As a result, the compact also likely cracks or chips. When the compact cracks or chips in this manner, the production yield drops, thus increasing the production costs disadvantageously. What is worse, valuable material resources cannot be utilized effectively enough. Problems like these are particularly noticeable if, while a material alloy for an R—Fe—B-type rare earth magnet is finely pulverized with a jet mill, for example, powder particles of relatively large sizes are screened out using a classifying rotor to increase the coercivity of the resultant magnet.

SUMMARY OF THE INVENTION

In order to solve the problems described above, preferred embodiments of the present invention provide an alloy powder for an R—Fe—B-type rare earth magnet that achieves excellent compactibility even at a relatively low compaction pressure.

According to one preferred embodiment of the present invention, an inventive method of making an alloy powder for an R—Fe—B-type rare earth magnet includes the steps of preparing a material alloy that is to be used to form the R—Fe—B-type rare earth magnet and that includes a chilled structure that constitutes about 2 volume percent to about 20 volume percent of the material alloy, coarsely pulverizing the material alloy for the R—Fe—B-type rare earth magnet by utilizing a hydrogen occlusion phenomenon to obtain a coarsely pulverized powder, finely pulverizing the coarsely pulverized powder and removing at least some of fine powder particles having particle sizes of about 1.0 μm or less from the finely pulverized powder, thereby reducing the volume fraction of the fine powder particles having the particle sizes of about 1.0 μm or less, and covering the surface of remaining ones of the powder particles with a lubricant after the step of removing at least some of the fine powder particles has been performed.

In a preferred embodiment of the present invention, the alloy powder is preferably made so as to have a volume particle size distribution with a single peak and a mean particle size (FSSS particle size) of about 4 μm or less. In the volume particle size distribution, a total volume of particles that have particle sizes falling within a first particle size range is preferably greater than a total volume of particles that have particle sizes falling within a second particle size range. The first particle size range is defined by a particle size A representing the peak of the volume particle size distribution and a predetermined particle size B that is smaller than the particle size A. The second particle size range is defined by the particle size A and another predetermined particle size C that is larger than the particle size A. The particle size C minus the particle size A is preferably substantially equal to the particle size A minus the particle size B.

In another preferred embodiment of the present invention, the alloy powder may be made so as to have a volume particle size distribution with a single peak and a mean particle size (FSSS particle size) of about 4 μm or less. A particle size D representing a center of a full width at half maximum of the volume particle size distribution may be smaller than a particle size A representing the peak of the volume particle size distribution.

In still another preferred embodiment, the step of finely pulverizing the coarsely pulverized powder is performed using a high-speed flow of an inert gas.

In this particular preferred embodiment, the coarsely pulverized powder may be finely pulverized using a jet mill. Alternatively, the coarsely pulverized powder may be finely pulverized using a pulverizer that is combined with a classifier for classifying the powder particles output from the pulverizer.

In yet another preferred embodiment, the material alloy for the rare earth magnet may be obtained by cooling a melt of the material alloy at a cooling rate of approximately $10^{2°}$ C./sec to approximately $2\times10^{4°}$ C./sec.

In that case, the melt of the material alloy is preferably cooled by a strip casting process.

In another preferred embodiment of the present invention, an inventive method for producing an R—Fe—B-type rare earth magnet includes the steps of preparing the alloy powder for the R—Fe—B-type rare earth magnet by any of the above-described preferred embodiments of the inventive method of making an alloy powder, compacting the alloy powder for the R—Fe—B-type rare earth magnet at a pressure of about 100 MPa or less by a uniaxial pressing process, thereby making a powder compact, and sintering the powder compact to produce a sintered magnet.

According to yet another preferred embodiment of the present invention, an inventive alloy powder for an R—Fe—B-type rare earth magnet is produced by pulverizing a material alloy that is to be used to form the for the R—Fe—B-type rare earth magnet and that includes a chilled structure that constitutes about 2 volume percent to about 20 volume percent of the material alloy. The powder preferably has a volume particle size distribution with a single peak and a mean particle size (FSSS particle size) of about 4 μm or less. In the volume particle size distribution, a total volume of particles that have particle sizes falling within a first particle size range is greater than a total volume of particles that have particle sizes falling within a second particle size range. The first particle size range is defined by a particle size A representing the peak of the volume particle size distribution and a predetermined particle size B that is smaller than the particle size A. The second particle size range is defined by the particle size A and another predetermined particle size C that is larger than the particle size A. The particle size C minus the particle size A is preferably substantially equal to the particle size A minus the particle size B.

In a further preferred embodiment of the present invention, an inventive alloy powder for an R—Fe—B-type rare earth magnet is obtained by pulverizing a material alloy that is to be used to form the R—Fe—B-type rare earth magnet and that includes a chilled structure that constitutes about 2 volume percent to about 20 volume percent of the material alloy. The powder preferably has a volume particle size distribution with a single peak and a mean particle size (FSSS particle size) of about 4 μm or less. A particle size D representing a center of a full width at half maximum of the volume particle size distribution is preferably smaller than a particle size A representing the peak of the volume particle size distribution.

According to still another preferred embodiment of the present invention, an inventive alloy powder for an R—Fe—B-type rare earth magnet includes a chilled structure that constitutes about 2 volume percent to about 20 volume percent of the alloy powder. The powder preferably has a mean particle size of about 2 μm to about 10 μm. The fraction of fine powder particles with particle sizes of about 1.0 μm or less is preferably controlled to constitute about 10% or less of the total volume of all powder particles. The surface of the powder particles is preferably covered with a lubricant.

In a preferred embodiment of the present invention, the powder is preferably prepared by pulverizing a rapidly solidified alloy that has been obtained by cooling a melt of a material alloy at a cooling rate of approximately $10^{2°}$ C./sec to approximately $2\times10^{4°}$ C./sec.

In yet another preferred embodiment of the present invention, an inventive R—Fe—B-type rare earth magnet is made from the inventive alloy powder for the R—Fe—B-type rare earth magnet that is produced according to other preferred embodiments of the present invention described above.

Other features, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
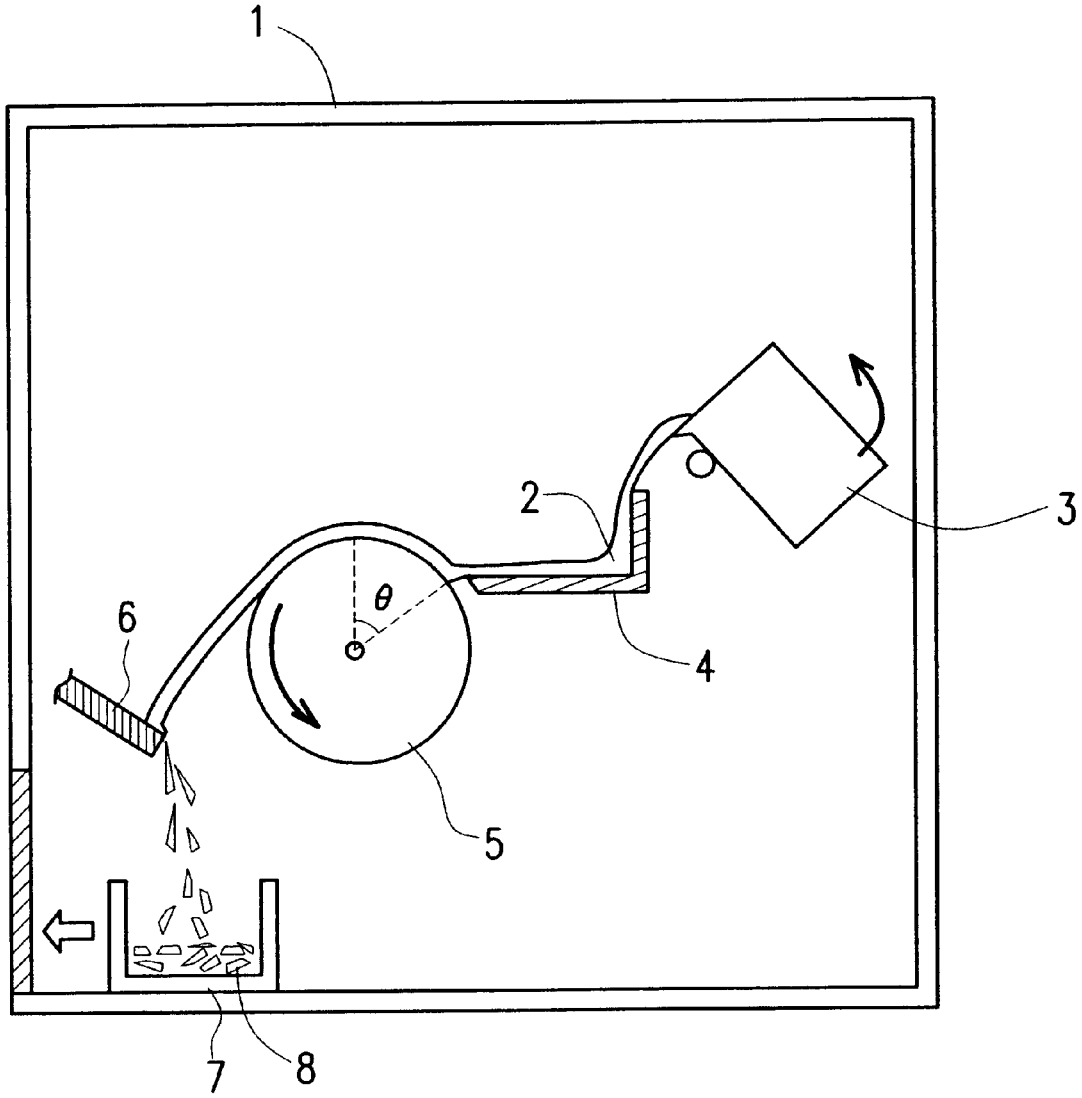
FIG. 1 illustrates an arrangement for a single-roller-type strip caster preferably used in a preferred embodiment of the present invention.

The present inventors extensively studied how the microcrystalline structure of a rapidly solidified alloy prepared by a strip casting process, for example, influences the particle size distribution of a powder obtained from the alloy. As a result, the present inventors discovered that if the volume percentage of a chilled structure included in the rapidly solidified alloy is controlled to be within a range of about 2 volume percent to about 20 volume percent of the alloy, a finely pulverized powder with a particle size distribution that greatly improves the powder compactibility can be obtained. The basic concepts of preferred embodiments of the present invention are based on this discovery.

As used herein, the "chilled structure" refers to a crystalline phase that is formed around the surface of a cooling member (e.g., a chill roller) of a melt quenching machine soon after a melt of an R—Fe—B-type rare earth alloy has come into contact with the surface of the cooling member and has started to solidify. Compared to a columnar (or dendrite) structure that will be formed after the initial stage of the rapid cooling/solidification process, the chilled structure is more isotropic (or isometric) and finer.

It was widely believed in the art that an R—Fe—B-type rare earth alloy should preferably include as small a volume fraction of chilled structure as possible. For example, Japanese Laid-Open Publication No. 10-317110 teaches that the creation of the chilled structure should be suppressed because the existence of that structure is believed to be a non-negligible factor to be considered when forming super-fine powder particles. Japanese Laid-Open Publication No. 10-317110 also proposes that to minimize the creation of the chilled structure, the surface of a roller that comes into contact with a molten alloy during the rapid solidification process of a material alloy should have its thermal conductivity decreased.

However, the present inventors discovered and confirmed via experiments that if the percentage of the chilled structure was increased to about 2 volume percent or more of the entire rapidly solidified alloy, then a powder obtained by finely pulverizing the alloy had an appropriately broadened particle size distribution, thus improving the compact density (or green density) and compactibility of the resultant powder compact. These effects were achieved because the isometric chilled structure would have been pulverized and would still be included in the finely pulverized powder.

Thus, according to preferred embodiments of the present invention, first, a rapidly solidified alloy including the chilled structure constituting about 2 volume percent to about 20 volume percent of the alloy is subjected to a hydrogen process, thereby coarsely pulverizing the alloy (i.e., a material alloy for a rare earth magnet). This coarse pulverization process will be herein referred to as a "first pulverization process". Next, the material alloy is finely pulverized. This fine pulverization process will be herein referred to as a "second pulverization process". Thereafter, the resultant powder particles preferably have their surface covered with a lubricant, thereby increasing the degree of alignment of the powder in a magnetic field while preventing the powder particles from being oxidized due to unwanted exposure to the air.

In preferred embodiments of the present invention, in order to broaden the particle size distribution of the powder by increasing the volume percentage of the chilled structure, the material alloy is preferably embrittled by utilizing a hydrogen occlusion phenomenon before being subjected to the fine pulverization process. The chilled structure includes a main phase of an $R_2Fe_{14}B$-type tetragonal compound and an R-rich phase, and has substantially the same composition as that of the remaining portion of the alloy. However, the chilled structure has a microcrystalline structure, in which crystals in the R-rich phase with a very small grain size exist at various locations around the main phase. Accordingly, if a structure such as this is subjected to a hydrogen occlusion process, then the R-rich phase swells and collapses earlier and faster than the main phase. Thus, this structure is finely pulverizable much more easily than any other type of structure. In other words, if this structure is subjected to only a mechanical pulverization process without being treated by the hydrogen process, then the final particle size distribution of the powder will not be a desired one and the particle size distribution of the powder will not be a desired one and the compactibility cannot be improved sufficiently.

Also, if only the hydrogen occluding and fine pulverization processes are performed in combination, then a great number of super-fine powder particles with particle sizes of about 1 $\mu$m or less might be formed. In that case, the resultant sintered magnet will have its oxygen concentration increased and its coercivity decreased disadvantageously. To avoid these undesirable results, according to preferred embodiments of the present invention, at least some of the super-fine powder particles with sizes of about 1.0 $\mu$m or less are screened out during the fine pulverization process, thereby limiting the volume fraction of those super-fine powder particles with sizes of about 1.0 $\mu$m or less to about 10% or less of the total volume of powder particles.

Hereinafter, specific preferred embodiments of the present invention will be described with reference to the accompanying drawings.

Material Alloy

A material alloy with a desired composition for an R—Fe—B-type rare earth magnet is prepared using a single-roller-type strip caster (which will be herein also referred to as a "melt quenching machine") such as that shown in FIG. 1. The melt quenching machine shown in FIG. 1 preferably includes a melt quenching chamber 1 in which a vacuum or a low-pressure inert atmosphere can be created. As shown in FIG. 1, the machine preferably includes a melting crucible 3, a chill roller 5, a shoot (or tundish) 4, and a collector 8. First, a material alloy is melted in the melting crucible 3 to make a melt 2. Next, the melt 2 is teemed by way of the shoot 4 onto the chill roller 5 so as to be rapidly cooled and solidified thereon. The rapidly solidified alloy then leaves the roller 5 as a thin-strip alloy 7 as the roller 5 rotates. Thereafter, the thin-strip alloy 7 is collected in the collector 8.

The melting crucible 3 is arranged to pour the melt 2, prepared by melting the material alloy, onto the shoot 4 at a substantially constant feeding rate. The feeding rate is arbitrarily controllable by tilting the melting crucible 3 at a desired angle, for example.

The outer circumference of the chill roller 5 is preferably made of a material with good thermal conductivity (e.g., copper or other suitable material). The roller 5 may have a diameter of about 30 cm to about 100 cm and a width of about 15 cm to about 100 cm. The chill roller 5 can cool itself by allowing water to flow through the inside of the roller 5. The roller 5 can be rotated at a predetermined velocity by a motor (not shown) or other suitable device. By controlling this rotational velocity, the surface velocity of the chill roller 5 is arbitrarily adjustable. The cooling rate achieved by this melt quenching machine is preferably controllable within a range from about $10^{2\circ}$ C./sec to approximately $2\times10^{4\circ}$ C./sec by selecting an appropriate rotational velocity for the chill roller 5, for example.

The shoot 4 is located at such a position that an angle θ is formed between a line connecting the center and top of the roller 5 to each other and a line connecting the center of the roller 5 to a point on the surface of the roller 5 that faces the far end of the shoot 4. The melt 2, which has been poured onto the shoot 4, is then teemed through the far end of the shoot 4 onto the surface of the chill roller 5.

The shoot 4 may be made of a ceramic, for example, or other suitable material. The shoot 4 can rectify the flow of the melt 2 by delaying the flow velocity of the melt 2 to such a degree so as to temporarily reserve the flow of the melt 2 that is being continuously supplied from the melting crucible 3 at a predetermined flow rate. This rectification effect can be further improved with a dam plate (not shown) for selectively damming back the surface flow of the melt 2 that has been poured onto the shoot 4.

By using this shoot 4, the melt 2 can be teemed so as to have a substantially constant width in the longitudinal direction of the chill roller 5. As used herein, the "longitudinal direction" of the chill roller 5 is equivalent to the axial direction of the roller 5. Also, the melt 2 being teemed can be spread so as to have a substantially uniform thickness. In addition, the shoot 4 can also adjust the temperature of the melt 2 that is going to reach the chill roller 5. The temperature of the melt 2 on the shoot 4 is preferably higher than the liquids temperature thereof by about 100° C. or more. This is because if the temperature of the melt 2 is too low, initial crystals, which will affect the properties of the resultant rapidly solidified alloy, might locally nucleate and remain in the rapidly solidified alloy. The temperature of the melt 2 on the shoot 4 is controllable by adjusting the temperature of the melt 2 that is being poured from the melting crucible 3 toward the shoot 4 or the heat capacity of the shoot 4 itself, for example. If necessary, a shoot heater (not shown) may be provided specially for this purpose.

Using this melt quenching machine, an alloy with a composition consisting of, for example, about 30.8 wt % (mass percent) of Nd; about 3.8 wt % of Pr; about 0.8 w % of Dy; about 1.0 wt % of B; about 0.9 wt % of Co; about 0.23 wt % of Al; about 0.10 wt % of Cu; and Fe and inevitably contained impurities as the balance is melted to form a melt of the alloy. The melt has its temperature kept at approximately 1350° C. and then brought into contact with, and rapidly cooled by, the surface of the chill roller, thereby obtaining flakes of strip-cast alloy with a thickness of about 0.1 mm to about 5 mm. The rapid solidification process may preferably be performed at a roller surface velocity of about 1 m/sec to about 3 m/sec and at a cooling rate of about $10^2$ to $2\times10^{4\circ}$ C./sec. In this preferred embodiment, to increase the volume percentage of a chilled structure intentionally, the pressure of the atmosphere inside the melt quenching chamber is preferably decreased so that the melt can have its heat dissipated more efficiently from the roller contact surface thereof (i.e., so that the melt can keep closer contact with the surface of the chill roller). It should be noted that even if the weight of the melt teemed per unit time is decreased, the resultant volume percentage of a chilled structure can also be increased because the cooling rate increases in that case.

The rapidly solidified alloy obtained in this manner is pulverized into flakes with sizes of about 1 mm to about 10 mm before being subjected to the next hydrogen pulverization process. It should be noted that a method of producing a material alloy by a strip casting process is also disclosed in U.S. Pat. No. 5,383,978, for example.

First Pulverization Process

Figure 2:
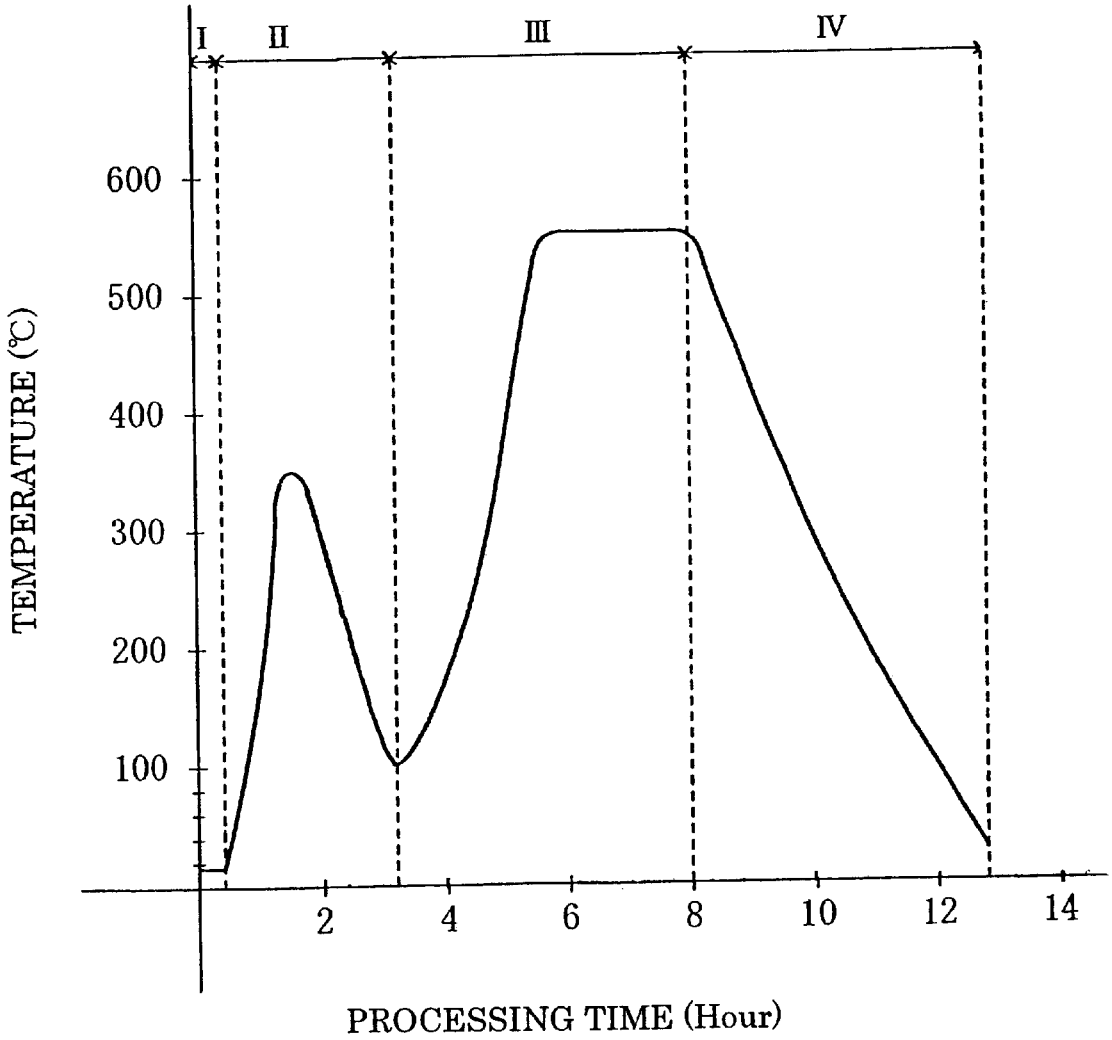
FIG. 2 is a graph illustrating an exemplary temperature profile for a hydrogen pulverization process to be carried out as a coarse pulverization process according to a preferred embodiment of the present invention.

The material alloy that has been coarsely pulverized into the flakes is then stuffed into a plurality of material packs (made of stainless steel, for example). After the packs have been placed on a rack, the rack with the packs is loaded into a hydrogen furnace. Then, the lid of the hydrogen furnace is closed to start a hydrogen embrittlement process (which will be herein also referred to as a "hydrogen pulverization process"). The hydrogen pulverization process may be performed following the temperature profile shown in FIG. 2, for example. In the example illustrated in FIG. 2, first, an evacuation process step I is executed for approximately 0.5 hours, followed by a hydrogen occlusion process step II for approximately 2.5 hours. In the hydrogen occlusion process step II, hydrogen gas is supplied into the furnace to create a hydrogen atmosphere inside the furnace. The hydrogen pressure in this process step is preferably about 200 kPa to about 400 kPa.

Subsequently, a dehydrogenation process step III is executed at a reduced pressure of about 0 Pa to about 3 Pa for approximately 5.0 hours, and then a material alloy cooling process step IV is performed for approximately 5.0 hours with argon gas being supplied into the furnace.

To improve the cooling efficiency, the cooling process step IV is preferably performed in the following manner. Specifically, when the temperature of the atmosphere inside the furnace is still relatively high (e.g., higher than about 100° C.) in the cooling process step IV, an inert gas (e.g., argon gas) with an ordinary temperature is supplied into the furnace for the cooling purpose. Thereafter, when the material alloy has its temperature decreased to a comparatively low level (e.g., about 100° C. or less), the inert gas that has been cooled to a temperature lower than the ordinary temperature (e.g., a temperature lower than room temperature by about 10° C.) is supplied into the furnace. The argon gas may be supplied at a volume flow rate of about 10 $m^3$/min to about 100 $m^3$/min.

When the temperature of the material alloy has decreased to about 20° C. to about 25° C., the inert gas with a temperature that is almost equal to the ordinary temperature (i.e., a temperature lower than room temperature by no greater than about 5° C.) is preferably supplied into the hydrogen furnace until the temperature of the material alloy reaches the ordinary temperature level. Then, no condensation will be produced inside the furnace when the lid of the hydrogen furnace is opened. If water exists inside the furnace due to any condensation, the water will be frozen or vaporized in the evacuation process step I. In that undesirable situation, it is difficult to increase the degree of vacuum and it takes too much time to carry out the evacuation process step I.

When the hydrogen pulverization process is completed, the coarsely pulverized alloy powder should preferably be unloaded from the hydrogen furnace in an inert atmosphere so as not to be exposed to the air. This prevents oxidation or heat generation of the coarsely pulverized powder and improves the magnetic properties of the resultant magnet. The coarsely pulverized material alloy is then stuffed into a plurality of material packs, which will be placed on a rack. Any of the apparatuses and methods for the hydrogen pulverization described in co-pending U.S. patent application Ser. No. 09/503,738, filed on Feb. 15, 2000 now U.S. Pat. No. 6,403,024, which is incorporated herein by reference, are useful in various preferred embodiments of the present invention.

As a result of this hydrogen pulverization process, the rare earth material alloy is pulverized to sizes of about 0.1 mm to about several millimeters with a mean particle size of about 500 $\mu$m or less. After the hydrogen pulverization, the embrittled material alloy is preferably further cracked to finer sizes and cooled with a cooling system such as a rotary cooler. If the material alloy unloaded still has a relatively high temperature, then the alloy should be cooled for a longer time using the rotary cooler or other suitable device.

On the surface of the coarsely pulverized powder obtained by this hydrogen pulverization process, a rare earth element such as Nd has been exposed a lot. Thus, the powder is very easily oxidizable at this point in time. To prevent the oxidation, about 0.04 wt % of zinc stearate is preferably added as a supplementary pulverization agent to the powder before the next fine pulverization process is started.

Second Pulverization Process

Next, the coarsely pulverized powder obtained by the first pulverization process is finely pulverized preferably with a jet mill machine. In the jet mill machine of this preferred embodiment, a cyclone classifier provided to remove unwanted fine powder particles is connected to a pulverizer.

Hereinafter, the fine pulverization process (i.e., the second pulverization process) using the jet mill machine will be described in detail with reference to FIG. 3.

Figure 3:
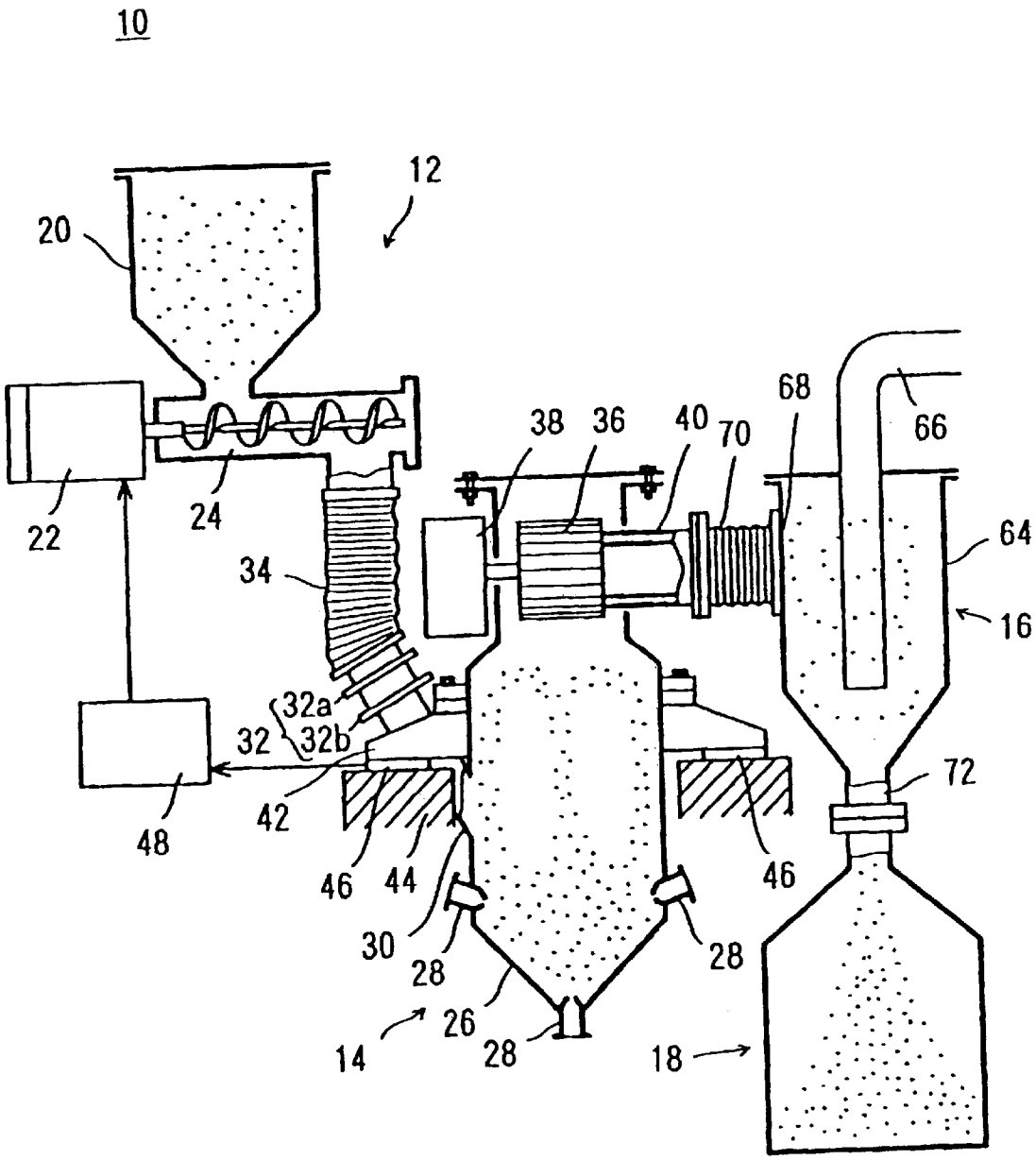
FIG. 3 is a cross-sectional view illustrating a construction of a jet mill machine preferably used to perform a fine pulverization process according to a preferred embodiment of the present invention.

As shown in FIG. 3, the jet mill machine 10 preferably includes a material feeder 12, a pulverizer 14, a cyclone classifier 16 and a collecting tank 18. The material feeder 12 feeds the rare earth alloy, which has been coarsely pulverized in the first pulverization process, to the pulverizer 14. The pulverizer 14 finely pulverizes the material to be pulverized that has been supplied from the material feeder 12. The cyclone classifier 16 classifies the powder particles obtained by pulverizing the material to be pulverized with the pulverizer 14. The collecting tank 18 collects the powder particles that have been sorted out by the cyclone classifier 16 so as to have a predetermined particle size distribution.

The material feeder 12 preferably includes a material tank 20 for receiving and storing the material to be pulverized, a motor 22 for controlling a rate at which the material to be pulverized is fed from the material tank 20, and a spiral screw feeder 24 connected to the motor 22.

The pulverizer 14 preferably includes a vertically mounted, substantially cylindrical pulverizer body 26. The lower portion of the pulverizer body 26 is provided with a plurality of nozzle fittings 28 for connecting to nozzles, through which an inert gas (e.g., nitrogen gas) is transmitted at high speed. A material feeding pipe 30 is connected to a side of the pulverizer body 26 to introduce the material to be pulverized into the pulverizer body 26.

The material feeding pipe 30 is provided with a pair of valves 32, i.e., upper and lower valves 32*a* and 32*b*, for temporarily holding the material to be fed and pulverized and keeping the pressure inside the pulverizer 14 unchanged. The screw feeder 24 and the material feeding pipe 30 are coupled together via a flexible pipe 34.

The pulverizer 14 further includes a classifying rotor 36 located inside the upper portion of the pulverizer body 26, a motor 38 placed outside of the upper portion of the pulverizer body 26, and a connection pipe 40 extending through the upper portion of the pulverizer body 26. The motor 38 drives the classifying rotor 36. Powder particles of a predetermined size or less are sorted out by the classifying rotor 36 and output from the pulverizer 14 through the connection pipe 40.

The pulverizer 14 includes a plurality of support legs 42, and is mounted on a base 44 with the legs 42 placed on the base 44. The base 44 is arranged so as to surround the outer circumference of the pulverizer 14. In this preferred embodiment, weight detectors 46 such as load cells are preferably provided between the legs 42 of the pulverizer 14 and the base 44. In accordance with the outputs of the weight detectors 46, a controller 48 finely adjusts the rotational velocity of the motor 22, thereby controlling the feeding rate of the material to be pulverized.

The cyclone classifier 16 preferably includes a classifier body 64, an exhaust pipe 66 inserted into the classifier body 64 so as to extend downward inside the body 64, and an inlet port 68 extending through one side of the classifier body 64 to introduce the powder particles that have been selectively passed by the classifying rotor 36. The inlet port 68 and the connection pipe 40 are coupled together via a flexible pipe 70. The classifier 16 further includes an outlet port 72 at the bottom of the classifier body 64 to connect the classifier body 64 to the collecting tank 18 in which desired finely pulverized powder particles should be collected.

The flexible pipes 34 and 70 may be made of a resin or rubber. Alternatively, the pipes 34 and 70 may also be made of a material with a high rigidity so long as the pipes 34 and 70 have an accordion or coil shape so as to have a required degree of flexibility. When these flexible pipes 34 and 70 are used, changes in the weights of the material tank 20, screw feeder 24, classifier body 64 and collecting tank 18 are not transmitted to the legs 42 of the pulverizer 14. Accordingly, just by using the weight detectors 46 under the legs 42, the weight of the material to be pulverized remaining in the pulverizer 14, as well as any variation in the weight, can be detected accurately enough and the rate at which the material to be pulverized is fed into the pulverizer 14 is controllable precisely enough.

Next, it will be described how to finely pulverize the coarsely pulverized powder using this jet mill machine 10.

First, the material to be pulverized is put into the material tank 20 and then fed into the pulverizer 14 by the screw feeder 24. In this case, the feeding rate of the material to be pulverized can be regulated by controlling the rotational velocity of the motor 22. The material being supplied by the screw feeder 24 is temporarily dammed at the valves 32. In this preferred embodiment, the upper and lower valves 32*a* and 32*b* open and close alternately. That is to say, while the upper valve 32*a* is open, the lower valve 32*b* is closed. While the upper valve 32*a* is closed, the lower valve 32*b* is open. By opening and closing the pair of valves 32*a* and 32*b* alternately in this manner, the gas with a predetermined pressure inside the pulverizer 14 will not leak toward the material feeder 12. Accordingly, when the upper valve 32*a* is opened, the material to be pulverized is supplied to the space between the upper and lower valves 32*a* and 32*b*. Next, when the lower valve 32*b* is opened, the material to be pulverized is guided through the material feeding pipe 30 into the pulverizer 14. The valves 32 are driven at a high speed by a sequencer (not shown), which is provided separately from the controller 48, so that the material to be pulverized is fed into the pulverizer 14 continuously.

The material to be pulverized that has been fed into the pulverizer 14 is blown up by the high-speed jets of inert gas injected through the nozzle fittings 28 and swirl together with high-speed gas flows inside the pulverizer 14. While swirling, the particles of the material collide against each other so as to be finely pulverized.

The powder particles, which have been finely pulverized in this manner, are guided upward by ascending gas flows to reach the classifying rotor 36, where the particles are classified (i.e., only particles of a predetermined size or less are selectively passed and coarse particles are thrown down to be pulverized again). The powder particles that have been pulverized to the predetermined size or less are passed through the connection pipe 40 and flexible pipe 70 and then introduced into the classifier body 64 of the cyclone classifier 16 via the inlet port 68. By using the classifying rotor 36, powder particles of sizes greater than a particle size representing the peak of the particle size distribution can be removed efficiently. If there are a large number of powder particles with sizes of greater than about 10 $\mu$m in the resultant powder, then the coercivity of a sintered magnet made from the powder should be lower than expected. Thus, the volume fraction of those powder particles having sizes of greater than about 10 $\mu$m is preferably reduced by using the classifying rotor 36. In this preferred embodiment, the fraction of the particles with sizes of greater than about 10 $\mu$m is restricted to about 10% or less of the total volume of powder particles in the resultant powder.

Powder particles having relatively large sizes (i.e., equal to or greater than the predetermined particle size) are sorted out by the classifier 16 and then deposited in the collecting tank 18 located under the classifier body 64. On the other hand, super-fine powder particles are blown up by the inert gas flows and most of them are output from the classifier 16 through the exhaust pipe 66. In this preferred embodiment, most of the super-fine powder particles are eliminated through the exhaust pipe 66, thereby reducing the volume fraction of remaining super-fine powder particles (with sizes of about 1.0 $\mu$m or less) to the total volume of powder particles collected in the collecting tank 18. Preferably, the volume fraction of those remaining super-fine powder particles with sizes of about 1.0 $\mu$m or less is controlled at approximately 10% or less of the total volume of powder particles collected.

Once those R-rich super-fine powder particles have been mostly removed in this manner, a smaller amount of rare earth element R will be oxidized in the resultant sintered magnet. As a result, the magnet has greatly improved magnetic properties.

As described above, in this preferred embodiment, the cyclone classifier 16 with the blow-up function is used as a classifier connected to the jet mill (i.e., pulverizer 14) as a succeeding stage member thereof. In the cyclone classifier 16 of this type, most of the super-fine powder particles with sizes equal to or less than the predetermined particle size are blown up and then output from the jet mill machine 10 through the pipe 66 without being collected in the collecting tank 18.

The particle sizes of the super-fine powder particles to be exhausted through the pipe 66 are controllable by appropriately determining cyclone parameters as described in "Powder Technology Pocketbook", Kogyo Chosa-kai Publishing Co., Ltd., pp. 92–96, for example, and by regulating the pressure of the inert gas flows.

According to this preferred embodiment, an alloy powder, which preferably has a mean particle size (which is an FSSS particle size as defined by Fisher Sub-Sieve Sizer method) of e.g., about 4.0 $\mu$m or less, and in which the fraction of super-fine powder particles with sizes of about 1.0 $\mu$m or less is approximately 10% or less of the total volume of powder particles, can be obtained.

To minimize the oxidation in the pulverization process, the concentration of oxygen contained in the high-speed inert gas flows for use in the fine pulverization process should preferably be reduced to about 1,000 ppm by volume to about 20,000 ppm by volume, more preferably to about 5,000 ppm by volume to about 10,000 ppm by volume. A fine pulverization method including the control of oxygen concentration in the high-speed gas flows is described in Japanese Patent Examined Publication No. 6-6728.

By controlling the concentration of oxygen contained in the atmosphere during the fine pulverization process in this manner, the concentration of oxygen contained in the finely pulverized alloy powder is preferably controlled to be about 6,000 ppm by mass or less. This is because if the concentration of oxygen contained in the rare earth alloy powder exceeds about 6,000 ppm by mass, the percentage of non-magnetic oxides in the resultant sintered magnet increases too much, thus deteriorating the magnetic properties of the resultant sintered magnet.

In this preferred embodiment, R-rich super-fine powder particles are removable appropriately. Accordingly, the concentration of oxygen in the powder is controllable at about 6,000 ppm by mass or less by regulating the concentration of oxygen in the inert atmosphere during the fine pulverization process. However, unless those R-rich super-fine powder particles were removed, the volume fraction of the super-fine powder particles would exceed approximately 10% of the total volume of powder particles collected. In that case, no matter how much the concentration of oxygen in the inert atmosphere is reduced, the concentration of oxygen in the finally obtained powder should exceed about 6,000 ppm by mass. It should be noted that if the powder is compacted in the air, the powder preferably contains oxygen at 3,500 ppm or more as disclosed in U.S. patent application Ser. No. 09/801,096, According to this preferred embodiment, a chilled structure is included in the rapidly solidified alloy. Thus, if the alloy is pulverized through these processes, the resultant powder will have a relatively small mean particle size but a sufficiently broad particle size distribution (as for particle sizes smaller than the peak thereof). Accordingly, a finely pulverized powder with excellent compactibility can be obtained.

In the preferred embodiment described above, the second pulverization process is performed using the jet mill machine 10 constructed as shown in FIG. 3. However, the present invention is not limited to this particular preferred embodiment, but is applicable to a jet mill machine with any other construction or any other type of pulverizer (e.g., attritor or ball mill pulverizer). As an alternative classifier for removing the super-fine powder particles, a centrifugal classifier such as a FATONGEREN type classifier or a micro-separator may also be used instead of the cyclone classifier.

Addition of Lubricant

A liquid lubricant or binder, which is preferably mainly composed of an aliphatic ester, for example, is added to the material alloy powder that is prepared by the above-described process. For example, about 0.15 wt % to about 5.0 wt % of lubricant may be added to, and mixed with, the powder using a machine such as a rocking mixer within an inert atmosphere. Examples of the aliphatic esters include methyl caproate, methyl caprate and methyl laurate. The lubricant should be vaporizable and removable in a subsequent process step. Also, if the lubricant itself is a solid that is hard to mix with the alloy powder uniformly, then the lubricant may be diluted with a solvent. As the solvent, a petroleum solvent such as isoparaffin or naphthenic solvent may be used. The lubricant may be added at any time, including before, during, or after the fine pulverization process. The liquid lubricant covers the surface of the powder particles, thereby preventing the particles from being oxidized. In addition, the liquid lubricant can also uniformize the density of the powder being compacted to reduce friction between the particles, thus improving the compactibility thereof. Furthermore, the liquid lubricant can also minimize the disorder in magnetic alignment. Alternatively, a solid lubricant such as zinc stearate may also be used. Then, the solid lubricant may be mixed with the alloy being pulverized. Other suitable lubricants may be used.

Compaction

Next, the magnetic powder prepared by the above-described process is compacted in an aligning field using known presses. In this preferred embodiment, to increase the degree of alignment in the magnetic field, the compaction pressure is preferably controlled within a range from about 5 MPa to about 100 MPa, more preferably from about 15 MPa to about 40 MPa. When the compaction process is completed, the powder compact is brought upward by a lower punch and taken out of the press.

In this preferred embodiment, the powder prepared has had its compactibility improved. Accordingly, the as-pressed compact can have its springback reduced, and the resultant powder compact is much less likely to experience cracks or chips. Also, by setting the compaction pressure relatively low, a powder compact having a high degree of magnetic alignment can be obtained while having a complex shape with a good production yield. In this manner, this preferred embodiment greatly reduces both the overall process time and the amount of the material wasted by a polishing process, for example, as compared to a known process in which a block-like sintered magnet is formed first and then processed into a desired shape.

Next, the compact is placed on a sintering bedplate made of molybdenum, for example, and then introduced, along with the bedplate, into a sintering case. The sintering case including the compact is transported to a sintering furnace, where the compact is subjected to a known sintering process to produce a sinter. The sinter is then subjected to aging treatment, surface polishing or coating deposition if necessary.

In this preferred embodiment, the powder to be compacted preferably includes easily-oxidizable R-rich super-fine powder particles at a much reduced percentage. Accordingly, even just after the powder has been compacted, the compact much less likely generates heat or fires due to the oxidation. That is, the removal of the R-rich super-fine powder particles not only improves the magnetic properties but guarantees a higher degree of safety as well.

Example and Comparative Example

In this example of preferred embodiments of the present invention, a melt of an alloy, including about 30.8 wt % of Nd, about 1.2 w % of Dy, about 1.0 wt % of B, about 0.3 wt % of Al; and Fe as the balance, was cooled and solidified at a controlled melt feeding rate, thereby changing the percentage of a chilled structure in the resultant rapidly solidified alloy within a range from about 0 to about 25 volume percent.

Figure 4:
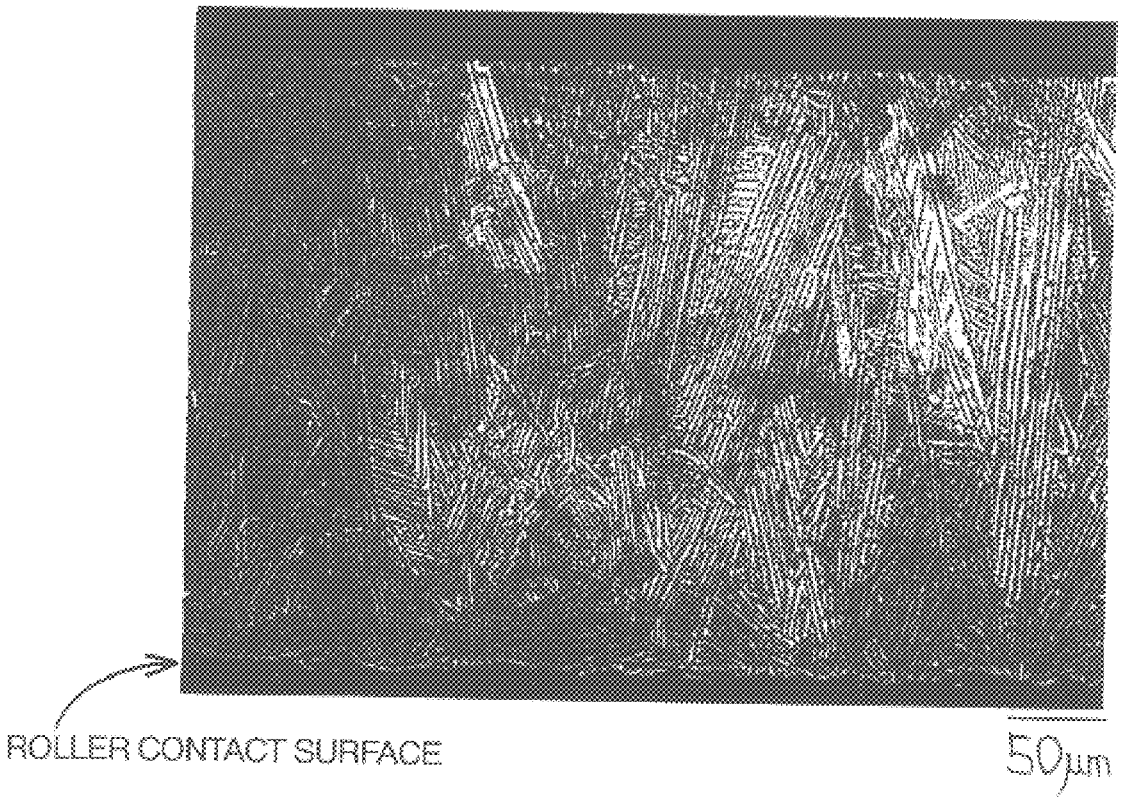
FIG. 4 is a microgram illustrating a microcrystalline cross-sectional structure of a rapidly solidified alloy in which no chilled structure has been formed.
Figure 5:
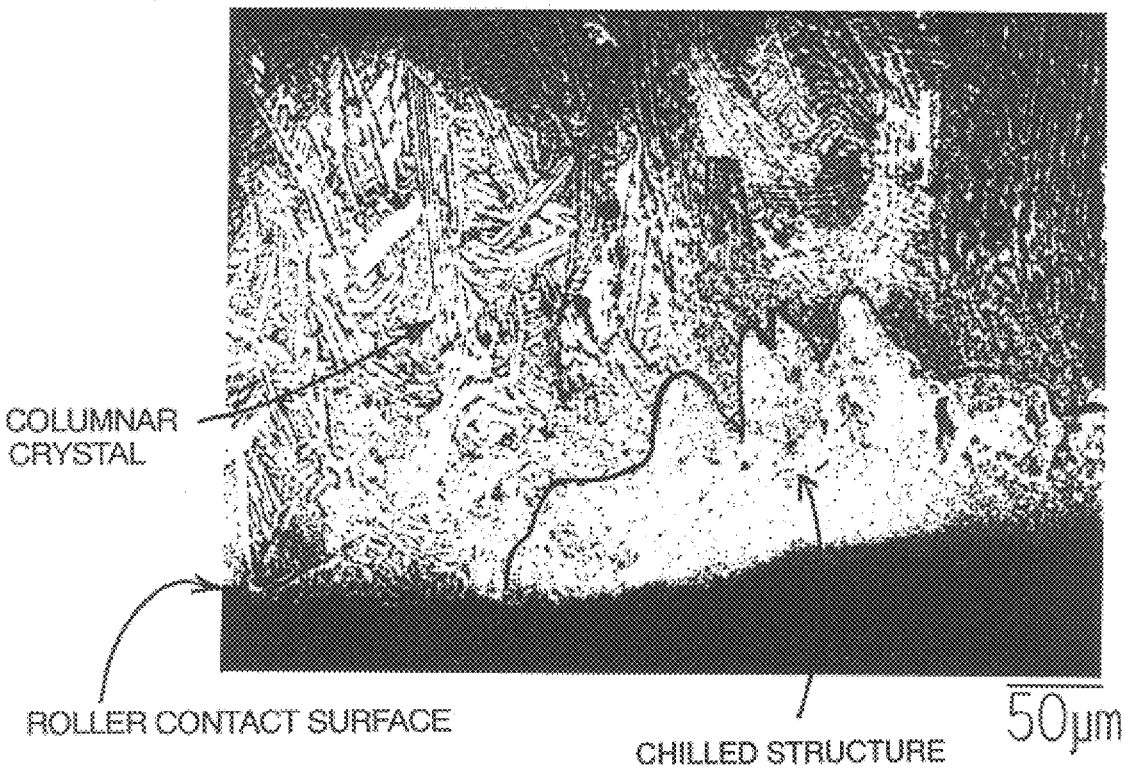
FIG. 5 is a microgram illustrating a microcrystalline cross-sectional structure of a rapidly solidified alloy in which a chilled structure has been formed.

FIG. 4 is a microgram illustrating a microcrystalline cross-sectional structure of a rapidly solidified alloy in which no chilled structure has been formed. FIG. 5 is a microgram illustrating a microcrystalline cross-sectional structure of a rapidly solidified alloy in which a chilled structure has been formed at about 10 volume percent.

In FIGS. 4 and 5, the lower surface of the rapidly solidified alloy corresponds to a surface thereof that was in contact with the surface of a chill roller. In the rapidly solidified alloy shown in FIG. 4, a columnar crystal structure covers the entire cross section thereof. In the rapidly solidified alloy shown in FIG. 5 on the other hand, a chilled structure, which has a fine structure different from that of columnar crystals, has been formed in a region about several tens $\mu$m over the roller contact surface.

The volume percentage of the chilled structure in a rapidly solidified alloy (which will be herein referred to as a "chilled structure percentage") can be measured by reference to a microgram illustrating a cross section of the rapidly solidified alloy and calculating the area ratio of the chilled structure observed in the microgram. In the microgram representing the cross section of the rapidly solidified alloy, the chilled structure is identifiable by determining whether or not the columnar structure exists in a given portion thereof. That is to say, if a portion of the rapidly solidified alloy near the roller contact surface has no columnar structure and if the crystals existing in that portion have grain sizes of about 5 $\mu$m or less, then that portion is regarded as having a chilled structure.

Figure 6:
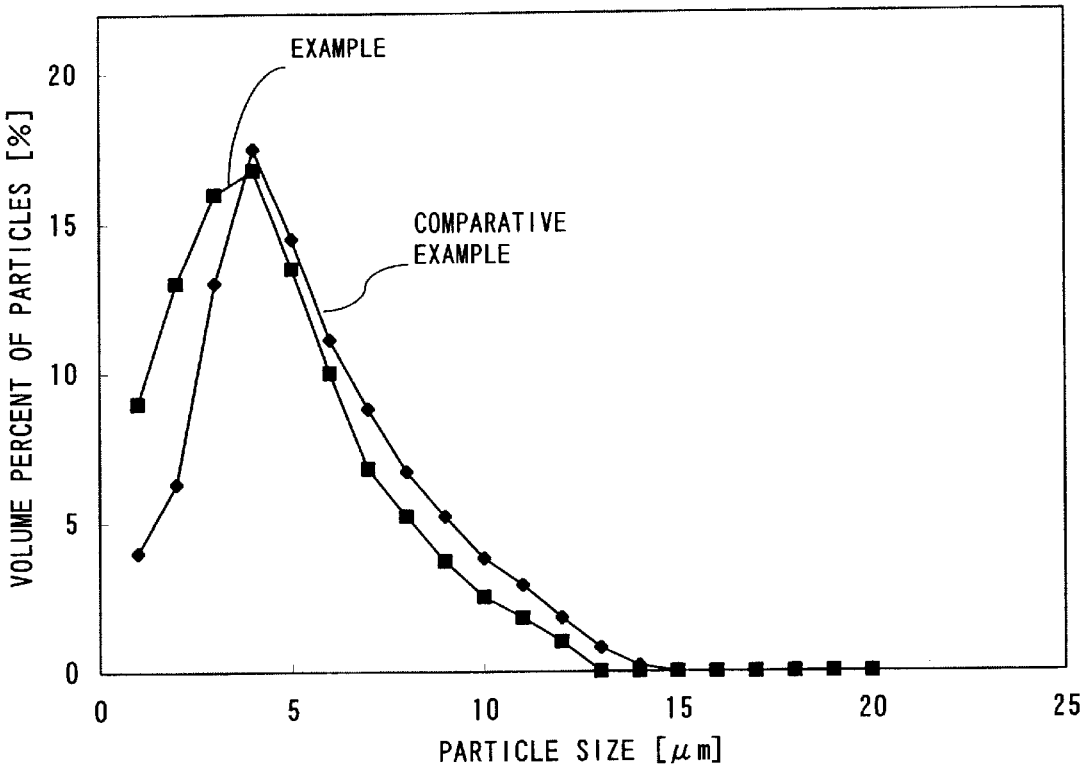
FIG. 6 is a graph illustrating the particle size distribution of an alloy powder for a rare earth magnet in an example of preferred embodiments of the present invention and that of a comparative example.

The rapidly solidified alloy was pulverized by performing the pulverization processes described above, thereby obtaining a finely pulverized powder with a mean particle size (or an FSSS particle size in this case) of about 2.8 $\mu$m to about 4.0 μm. FIG. 6 illustrates the particle size distribution of a finely pulverized powder made from a rapidly solidified alloy with a chilled structure percentage of about 0 volume percent (representing a comparative example) and that of a finely pulverized powder made from a rapidly solidified alloy with a chilled structure percentage of about 10 volume percent (representing an example of preferred embodiments of the present invention). The particle size distributions were measured using a particle size analyzer "HELOS" produced by Sympatec Corp. This particle size analyzer utilizes a decrease in the quantity of a high-speed scanning laser beam transmitted when the laser beam is blocked by powder particles. Thus, the particle size analyzer can obtain the particle size directly from the time it takes for the laser beam to pass the particles.

In the graph illustrated in FIG. 6, the volume percentage of particles with various sizes falling within a particle size range from about 0.5 to about 1.5 μm is plotted as a volume percentage of particles with a particle size of about 1 μm. In the same way, the volume percentage of particles with various sizes falling within a particle size range from about 1.5 to about 2.5 μm is plotted as a volume percentage of particles with a particle size of about 2 μm. That is to say, the total volume percentage of particles with various sizes falling within a particle size range from approximately (N−0.5) to approximately (N+0.5) μm is plotted as a volume percentage of particles with a particle size of N μm. A particle size distribution of this type will be herein referred to as a "volume particle size distribution"

The following results are clearly understandable from FIG. 6.

The volume particle size distributions of the example of preferred embodiments of the present invention and the comparative example each have a single peak. However, the particle size distribution corresponding to the rapidly solidified alloy including the chilled structure is broader than the distribution corresponding to the rapidly solidified alloy including no chilled structure.

As for the example of preferred embodiments of the present invention, a particle size A representing the peak of the volume particle size distribution is about 4 μm. Also, the total volume of particles with sizes falling within a first particle size range from the particle size A to a predetermined particle size B (where particle size A>particle size B) is greater than the total volume of particles with sizes falling within a second particle size range from the particle size A to another predetermined particle size C (where particle size C>particle size A). It should be noted that the width of the second particle size range (i.e., particle size C minus particle size A) is preferably substantially equal to that of the first particle size range (i.e., particle size A minus particle size B).

Figure 7A:
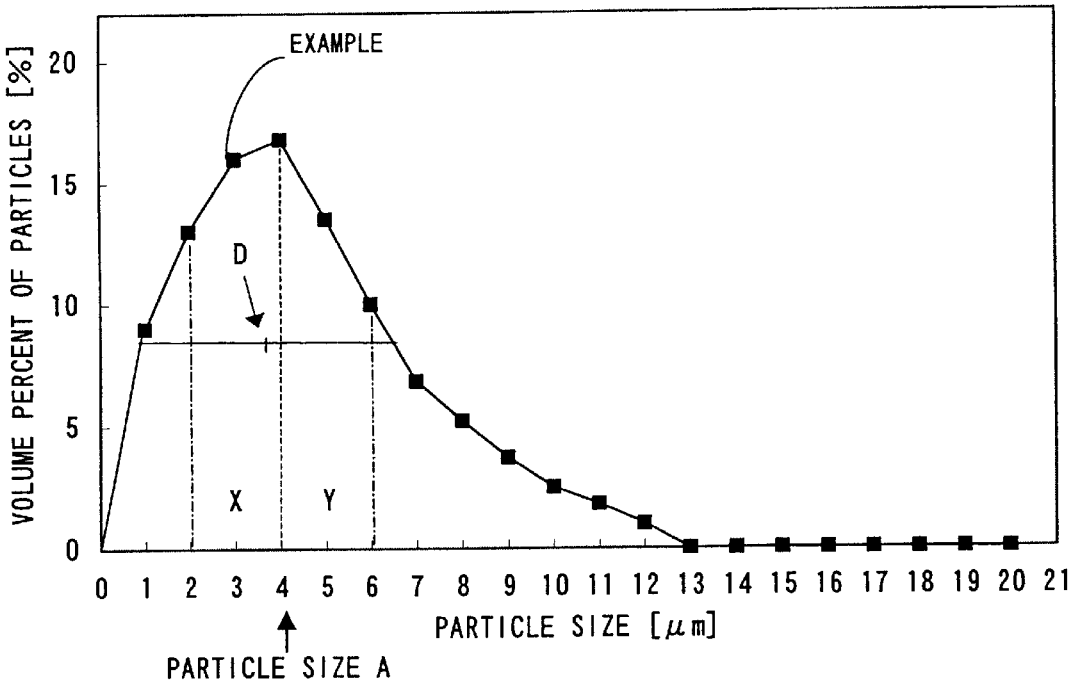
FIG. 7A is a graph illustrating the particle size distribution of the example of preferred embodiments of the present invention.

The total volume of particles with sizes falling within a predetermined particle size range corresponds to the area of a region that is surrounded by the curve representing the particle size distribution and two lines defining the particle size range. FIG. 7A is a graph illustrating only the curve shown in FIG. 6 for the example of preferred embodiments of the present invention. As shown in FIG. 7A, the total volume of particles with particle sizes of about 2 μm to about 4 μm corresponds to the area of the region X. In the same way, the total volume of particles with particle sizes of about 4 μm to about 6 μm corresponds to the area of the region Y. As can be seen from FIG. 7A, the area of the region X is greater than that of the region Y.

Figure 7B:
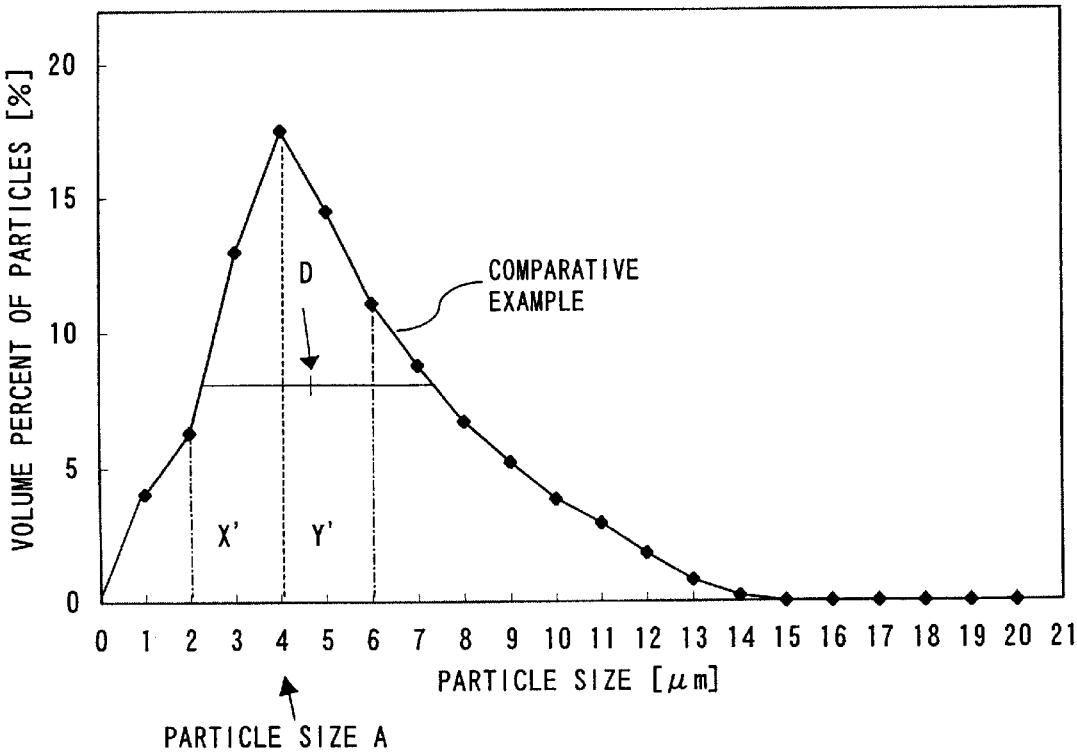
FIG. 7B is a graph illustrating the particle size distribution of the comparative example.

FIG. 7B is a graph illustrating only the curve shown in FIG. 6 for the comparative example. As shown in FIG. 7B, the total volume of particles with particle sizes of about 2 μm to about 4 μm corresponds to the area of the region X'. In the same way, the total volume of particles with particle sizes of about 4 μm to about 6 μm corresponds to the area of the region Y'. As can be seen from FIG. 7B, the area of the region X' is smaller than that of the region Y'.

As also can be seen from FIG. 7A, in the example of preferred embodiments of the present invention, a particle size D corresponding to the center of the full width at half maximum of the volume particle size distribution is smaller than the particle size A representing the peak of the volume particle size distribution. In the comparative example on the other hand, a particle size D corresponding to the center of the full width at half maximum of the volume particle size distribution is larger than the particle size A representing the peak of the volume particle size distribution as shown in FIG. 7B.

It should be noted that the mean particle size (or FSSS particle size in this case) of the example was about 3.2 μm, while that of the comparative example was about 3.5 μm. In the prior art, if the powder has its mean particle size that is decreased in this manner, then the flowability thereof deteriorates seriously. In contrast, according to preferred embodiments of the present invention, a portion of the particle size distribution covering the smaller sizes has a broadened width. For that reason, the powder of preferred embodiments of the present invention is much less likely to have its compactibility decreased. In addition, according to preferred embodiments of the present invention, the other portion of the particle size distribution covering the larger sizes has a narrowed width and the mean particle size is relatively small. Thus, the resultant sintered magnet has fine crystal grains and its coercivity increases advantageously.

Next, about 0.3 wt % of methyl caproate, diluted with a petroleum solvent, was added to this powder and the mixture was compacted using a die press machine to obtain a powder compact with approximate dimensions of 25 mm×20 mm×20 mm. The compaction pressure was set at about 30 MPa. During the compaction process, an aligning field with an intensity of about 1200 kA/m was applied to the powder vertically to a uniaxial compaction direction. After the powder was compacted, the compact was sintered within an argon atmosphere. The sintering process was carried out at about 1060° C. for approximately 5 hours. After the sinter was subjected to an aging treatment, the resultant sintered magnet had its remanence $B_r$, coercivity $H_{cJ}$ and maximum energy product $(BH)_{max}$ measured. The results are shown in the following Table 1, in which the compact density and the magnetic properties are shown for each chilled structure percentage:

TABLE 1

| Chilled Structure | Compact | Magnet properties | | |
|---|---|---|---|---|
| Percentage (vol %) | Density (g/cm³) | $B_r$ (T) | $(BH)_{max}$ (kJ/m³) | $H_{cJ}$ (kA/m) |
| 0 | 4.18 | 1.328 | 335.1 | 1176.3 |
| 1 | 4.22 | 1.327 | 334.8 | 1175.6 |
| 2 | 4.31 | 1.326 | 334.0 | 1174.5 |
| 5 | 4.36 | 1.328 | 335.5 | 1168.7 |
| 10 | 4.38 | 1.325 | 333.3 | 1153.7 |
| 15 | 4.36 | 1.325 | 332.8 | 1152.6 |
| 20 | 4.39 | 1.326 | 333.9 | 1148.7 |
| 25 | 4.36 | 1.321 | 331.8 | 1141.2 |

As can be seen from Table 1, if the chilled structure percentage is about 2% or more, a compact density of approximately 4.3 g/cm$^3$ or more can be obtained and the compactibility improves. However, the larger the chilled structure percentage, the lower the coercivity. This is because the increase in volume percentage of easily oxidizable chilled structure adversely increases the volume of unwanted oxides in the rare earth magnet.

In view of these considerations, the chilled structure percentage is preferably about 2 vol % to about 20 vol %. If increasing the compact density should be given a higher priority, then the chilled structure percentage is preferably greater than about 5 vol %. On the other hand, if there is a strong need for avoiding the decrease in coercivity, then the chilled structure percentage is preferably about 15 vol % or less, more preferably about 10 vol % or less.

In the foregoing illustrative preferred embodiments, the present invention has been described as being applied to a rapidly solidified alloy prepared by a strip casting process. However, the present invention is not limited to these particular preferred embodiments. For example, the present invention is applicable effectively enough to an alloy prepared by a rapid cooling process including centrifugal casting, or other suitable alloys prepared by various rapid cooling processes.

Alloy Composition

As the rare earth element R, at least one element selected from the group consisting of Pr, Nd, Sm, Gd, Tb, Dy, Ho, Er, Tm and Lu may preferably be used. To realize a sufficiently high magnetization, about 50 at % or more of the rare earth element R is preferably Pr and/or Nd.

If the mole fraction of the rare earth element R is lower than about 8 at %, then α-Fe phase will precipitate, thus possibly decreasing the coercivity. On the other hand, if the mole fraction of the rare earth element R exceeds about 18 at %, an R-rich second phase will precipitate greatly in addition to the desired tetragonal $Nd_2Fe_{14}B$ phase. As a result, the magnetization might drop in that case. For these reasons, the rare earth element R preferably accounts for about 8% to about 18% of the total material alloy.

Examples of preferred transition metal elements, at least one of which is substituted for a portion of Fe, include not only Co but also Ni, V, Cr, Mn, Cu, Zr, Mb and Mo. However, Fe preferably accounts for about 50 at % or more of the entire transition metal elements included. This is because when Fe accounts for less than about 50 at %, the saturation magnetization itself of the $Nd_2Fe_{14}B$ compound decreases.

B and/or C are/is indispensable to precipitate the tetragonal $Nd_2Fe_{14}B$ crystal structure stably enough. If the mole fraction of B and/or C added is less than about 3 at %, then an $R_2T_{17}$ phase will precipitate, thus decreasing the coercivity and seriously deteriorating the loop squareness of the demagnetization curve. However, if the mole fraction of B and/or C added exceeds about 20 at %, then a second phase with a low magnetization will precipitate unintentionally.

To further improve the magnetic anisotropy of the resultant powder, another element M may be added. The additive M is preferably at least one element selected from the group consisting of Al, Ti, V, Cr, Ni, Ga, Zr, Nb, Mo, In, Sn, Hf, Ta and W. However, it is possible not to add these elements M at all. In adding at least one of them, the mole fraction of the additive M is preferably about 3 at % or less. This is because if the element M is added at a concentration of more than about 3 at %, then a non-ferromagnetic second phase will precipitate to decrease the magnetization disadvantageously. To obtain a magnetically isotropic powder, no additives M are needed. Even so, Al, Cu and/or Ga may be added to increase the intrinsic coercivity.

An inventive alloy powder for an R—Fe—B-type rare earth magnet is obtained by embrittling a rapidly solidified alloy, including an appropriate volume percentage of a chilled structure, through a hydrogen occlusion process and then finely pulverizing the embrittled alloy. Accordingly, the resultant powder has a particle size distribution optimized for improving the compactibility thereof. Consequently, according to preferred embodiments of the present invention, complex-shaped powder compacts with a high degree of magnetic alignment can be mass-produced with a good yield even if the compaction pressure is relatively low.

While the present invention has been described with respect to preferred embodiments thereof, it will be apparent to those skilled in the art that the disclosed invention may be modified in numerous ways and may assume many embodiments other than those specifically described above Accordingly, it is intended that the appended claims cover all modifications of the invention that fall within the true spirit and scope of the invention.

What is claimed is:

1. An alloy powder for an R—Fe—B-type rare earth magnet, the powder comprising a pulverized material alloy that is to be used to form The R—Fe—B-type rare earth magnet and that includes a chilled structure that constitutes about 2 volume percent to about 20 volume percent of the material alloy;

wherein the powder has a volume particle size distribution with a single peak and a mean particle size (FSSS particle size) of about 4 μm or less; and wherein in the volume particle size distribution, a total volume of particles that have particle sizes falling within a first particle size range is greater than a total volume of particles that have particle sizes falling within a second particle size range, where the first particle size range is defined by a particle size A representing the peak of the volume particle size distribution and a predetermined particle size B that is smaller than the particle size A, the second particle size range is defined by the particle size A and another predetermined particle size C that is larger than the particle size A, and the particle size C minus the particle size A is equal to the particle size A minus the particle size B.

2. The alloy powder according to claim 1, wherein the pulverized material alloy is a pulverized rapidly solidified alloy that was produced from a melt of a material alloy that was cooled at a cooling rate of about $10^{2\circ}$ C./sec to about $2\times10^{4\circ}$ C./sec.

* * * * *